US009403540B2

(12) United States Patent
Takahashi et al.

(10) Patent No.: US 9,403,540 B2
(45) Date of Patent: Aug. 2, 2016

(54) RAILROAD VEHICLE AND PLUG DOOR FOR RAILROAD VEHICLE

(71) Applicants: CENTRAL JAPAN RAILWAY COMPANY, Nagoya-shi, Aichi (JP); NIPPON SHARYO, LTD., Nagoya-shi, Aichi (JP); NABTESCO CORPORATION, Chiyoda-ku, Tokyo (JP)

(72) Inventors: Yukio Takahashi, Toyohashi (JP); Hiroki Tsunoda, Atami (JP); Soshi Kawakami, Kawasaki (JP); Yuya Futamura, Nagoya (JP); Tomoyuki Fukunaga, Saitama (JP); Tadahiro Mitsuda, Nagoya (JP); Genta Sakaki, Kobe (JP)

(73) Assignees: CENTRAL JAPAN RAILWAY COMPANY, Nagoya-shi (JP); NIPPON SHARYO, LTD., Nagoya-shi (JP); NABTESCO CORPORATION, Tokyo (JP)

( * ) Notice: Subject to any disclaimer, the term of this patent is extended or adjusted under 35 U.S.C. 154(b) by 0 days.

(21) Appl. No.: 14/646,296

(22) PCT Filed: Oct. 31, 2013

(86) PCT No.: PCT/JP2013/079605

§ 371 (c)(1),
(2) Date: May 20, 2015

(87) PCT Pub. No.: WO2014/080736

PCT Pub. Date: May 30, 2014

(65) Prior Publication Data

US 2015/0321677 A1 Nov. 12, 2015

(30) Foreign Application Priority Data

Nov. 21, 2012 (JP) ..... 2012-255745

(51) Int. Cl.
*B61D 19/00* (2006.01)
*B61D 19/02* (2006.01)
*E05D 15/10* (2006.01)

(52) U.S. Cl.
CPC ..... *B61D 19/009* (2013.01); *B61D 19/00* (2013.01); *B61D 19/02* (2013.01); *E05D 15/1002* (2013.01); *E05Y 2800/12* (2013.01); *E05Y 2900/51* (2013.01)

(58) Field of Classification Search
CPC ..... E05Y 2201/412; E05Y 2201/414; E05Y 2900/51; E05Y 2800/12; E05Y 2201/238; E05Y 2201/448; B61D 19/009; B61D 19/02; B61D 19/00; E05D 15/10; E05D 15/1002; E05D 15/1007; E05D 15/1068; E05D 15/1044; E05F 15/565; E05F 15/56; E05F 17/004; E05F 15/06
See application file for complete search history.

(56) References Cited

U.S. PATENT DOCUMENTS 3,636,658 A * 1/1972 Bollinger, Sr. ..... E05D 15/1002 49/219
4,087,939 A * 5/1978 Elguindy ..... E05F 17/004 49/118

(Continued)

FOREIGN PATENT DOCUMENTS

JP S51-160308 U 12/1976
JP H04-41458 U 4/1992

(Continued)

OTHER PUBLICATIONS

Jan. 21, 2014 International Search Report issued in International Patent Application No. PCT/JP2013/079605.

*Primary Examiner* — Mark Le
(74) *Attorney, Agent, or Firm* — Oliff PLC

(57) ABSTRACT

A railroad vehicle that moves a door to an airtight position and maintains air tightness of the door without increasing the size of a cylinder device; and a plug door for a railroad vehicle. When a door moves to a position, a piston extends in the vehicle width direction, a pressing member is contacts the inner surface of the door, and the door is moved toward a door frame. An auxiliary pressing device brings the piston into perpendicular contact with the inner surface of the door making it is possible to efficiently move and press the door without increasing the size of a cylinder device even when the door must be moved across a distance to arrive at an airtight position. The main pressing device is used to press the door toward the door frame.

17 Claims, 6 Drawing Sheets

(56) References Cited

U.S. PATENT DOCUMENTS 4,438,595 A * 3/1984 MacDonald ..... E05D 15/1007 49/219
4,669,220 A * 6/1987 Dilcher ..... B61D 19/008 49/219
4,924,625 A * 5/1990 Dilcher ..... B61D 19/008 49/212
5,140,770 A * 8/1992 Morvan ..... B61D 19/008 49/215
5,142,823 A * 9/1992 Brandenburg ..... B60J 5/062 49/118
5,263,280 A * 11/1993 Dilcher ..... B61D 19/009 49/212
5,483,769 A * 1/1996 Zweili ..... B61D 19/008 49/118
5,893,236 A * 4/1999 Krbec ..... B61D 19/008 49/118
6,385,910 B1 * 5/2002 Smink ..... B60J 5/062 49/120
6,539,669 B1 * 4/2003 Heidrich ..... B61D 19/008 16/87 R
6,792,717 B2 * 9/2004 Carlsson ..... E05F 15/646 49/118
7,426,803 B2 * 9/2008 Fronz ..... B61D 19/008 49/209
8,001,908 B2 * 8/2011 Webster ..... A63H 19/14 105/280
8,950,115 B2 * 2/2015 Andersson ..... E05D 15/1065 312/322

FOREIGN PATENT DOCUMENTS

JP H09-11895 A 1/1997
JP 2008-174151 A 7/2008

* cited by examiner

RAILROAD VEHICLE AND PLUG DOOR FOR RAILROAD VEHICLE

TECHNICAL FIELD

The present invention relates to a railroad vehicle and a plug door for a railroad vehicle, and more particularly, to a railroad vehicle that efficiently moves a door to an airtight position and makes it possible to ensure the air tightness of the door without increasing the size of a cylinder device even when the door must be moved across a distance to arrive at the airtight position, and a plug door for a railroad vehicle.

BACKGROUND ART

Conventional railroad vehicles, particularly high-speed railroad vehicles include ones equipped with a plug door. The plug door has a door form such that the outer surface thereof is flush with the outer surface of a vehicle body when the doorway is closed. This plug door allows reductions in air resistance and noise such as wind noise.

Furthermore, as for an airtight maintaining device included in the plug door, Patent Literature 1 listed below discloses a configuration in which a piston rod of a cylinder device 4 is extended, thereby causing a link member 5 to turn and press a door 1 in a closed position toward airtight packing 3 so as to maintain the air tightness of the door 1.

CITATION LIST

Patent Literature

Patent Literature 1: JP-A No. H09(1997)-11895

SUMMARY OF INVENTION

Technical Problem

However, the airtight maintaining device disclosed in the above-described Patent Literature 1, the following problem has arisen when the door 1 in the closed position must be moved across a distance to arrive at an airtight position. That is, in that case, it is necessary to increase the size of the link member 5 and, accordingly, to increase the size of the cylinder device 4.

Accordingly, the present invention has been made in order to address the above-described problem, and an object of the present invention is to provide a railroad vehicle that efficiently moves a door to an airtight position and makes it possible to ensure the air tightness of the door without increasing the size of a cylinder device even when the door must be moved across a distance to arrive at the airtight position, and a plug door for a railroad vehicle.

Solution to Problem and Advantageous Effects of Invention

The railroad vehicle according to the present invention offers the following advantages. That is, when a door is closed, the door is pressed by a second pressing device prior to being pressed by a first pressing device. The second pressing device is disposed to face an inner surface of the door and adapted to press the door toward a door frame. When a second piston is extended in a width direction of a vehicle body, the pressing member coupled to a leading end of the second piston abuts on the inner surface of the door and presses the door toward the door frame. Thus, the door is moved toward the door frame. In this manner, the second pressing device extends the second piston perpendicularly with respect to the inner surface of the door, and therefore it is possible to efficiently move the door toward the door frame without increasing the size of a cylinder device.

Thereafter, the door is pressed by the first pressing device. The first pressing device is disposed adjacent to the door in a longitudinal direction of the vehicle body and adapted to press the door toward the door frame. When a first piston is extended in the vehicle body longitudinal direction, a link mechanism operates and abuts on the inner surface of the door to press the door toward the door frame. In this manner, the first pressing device presses the door through the link mechanism, and therefore, even if an external force is applied from an outer surface of the door, not all external forces act on the piston. It is therefore possible to resist the external force and ensure the air tightness of the door without increasing the size of the piston. Consequently, there are the advantages of efficiently moving the door to an airtight position and making it possible to ensure the air tightness of the door without increasing the size of the cylinder device even when the door must be moved across a distance to arrive at the airtight position.

The railroad vehicle according another aspect of the present invention offers the following additional advantage. The first pressing device is disposed on the same level on both sides of the door so as to sandwich the door therebetween in the vehicle body longitudinal direction. The second pressing device is disposed on the same level on both sides of the door so as to sandwich the door therebetween in the vehicle body longitudinal direction. The first pressing device and the second pressing device are vertically alternately arranged. Thus, the door can be equally pressed. Therefore, there is the advantage of being able to ensure the air tightness of the door.

The railroad vehicle according another aspect of the present invention offers the following additional advantage. A blocking wall is provided in a manner protruding inward the vehicle on a door end side of the door. The blocking wall is disposed at a portion of the door on which the first pressing device or the second pressing device abuts, so as to surround that portion. Thus, it is possible to prevent, for example, a finger from being pinched between the inner surface of the door and the first pressing device or between the inner surface of the door and the second pressing device.

Furthermore, a door pocket opening the doorway and storing the door is provided with a shutter that opens and closes an entrance of the door pocket. A covering member is also provided at a leading end of the shutter for cover a portion through which the blocking wall passes while allowing passage of the blocking wall. Thus, even if the blocking wall is provided in a protruding manner on the door, the entrance of the door pocket can be covered. Therefore, there is the advantage of being able to prevent a finger from being pinched between the inner surface of the door and the first pressing device or between the inner surface of the door and the second pressing device due to, for example, the inadvertent entry of the finger from the portion through which the blocking wall passes.

The railroad vehicle according another aspect of the present invention offers the following additional advantage That is, a plug rail for guiding the door in movement in the vehicle body width direction extends between a first rail and a second rail. The first rail is suspended from a ceiling of the vehicle body and extends in the vehicle body longitudinal direction for guiding the door in reciprocal movement in the vehicle body longitudinal direction with respect to the doorway. The second rail is suspended from the ceiling of the vehicle body between the first rail and a side wall of the vehicle body and extends in the vehicle body longitudinal direction for guiding the door in reciprocal movement in the vehicle body longitudinal direction with respect to the doorway. In this manner, the plug rail is held at both ends by the first rail and the second rail. Thus, dangling of the leading end of the plug rail can be prevented. Therefore, there is the advantage of being able to reliably block the doorway and ensure the air tightness of the door.

The railroad vehicle according another aspect of the present invention offers the following additional advantage When the first piston is extended, the link member causes the arm to rotate about the rotary shaft, and the rotating roller turnably journaled to the leading end of the arm abuts the inner surface of the door and presses the door toward the door frame. In this case, even if an external force is applied from the outer surface of the door, the external force is distributed without acting directly upon the piston. Therefore, there is the advantage of being able to resist the external force and ensure the air tightness of the door without increasing the size of the piston.

A plug door for a railroad vehicle according to claim 6 offers the advantage of efficiently moving the door to an airtight position and making it possible to ensure the air tightness of the door without increasing the size of the cylinder device even when the door must be moved across a distance to arrive at the airtight position.

DESCRIPTION OF EMBODIMENT

Figure 1:
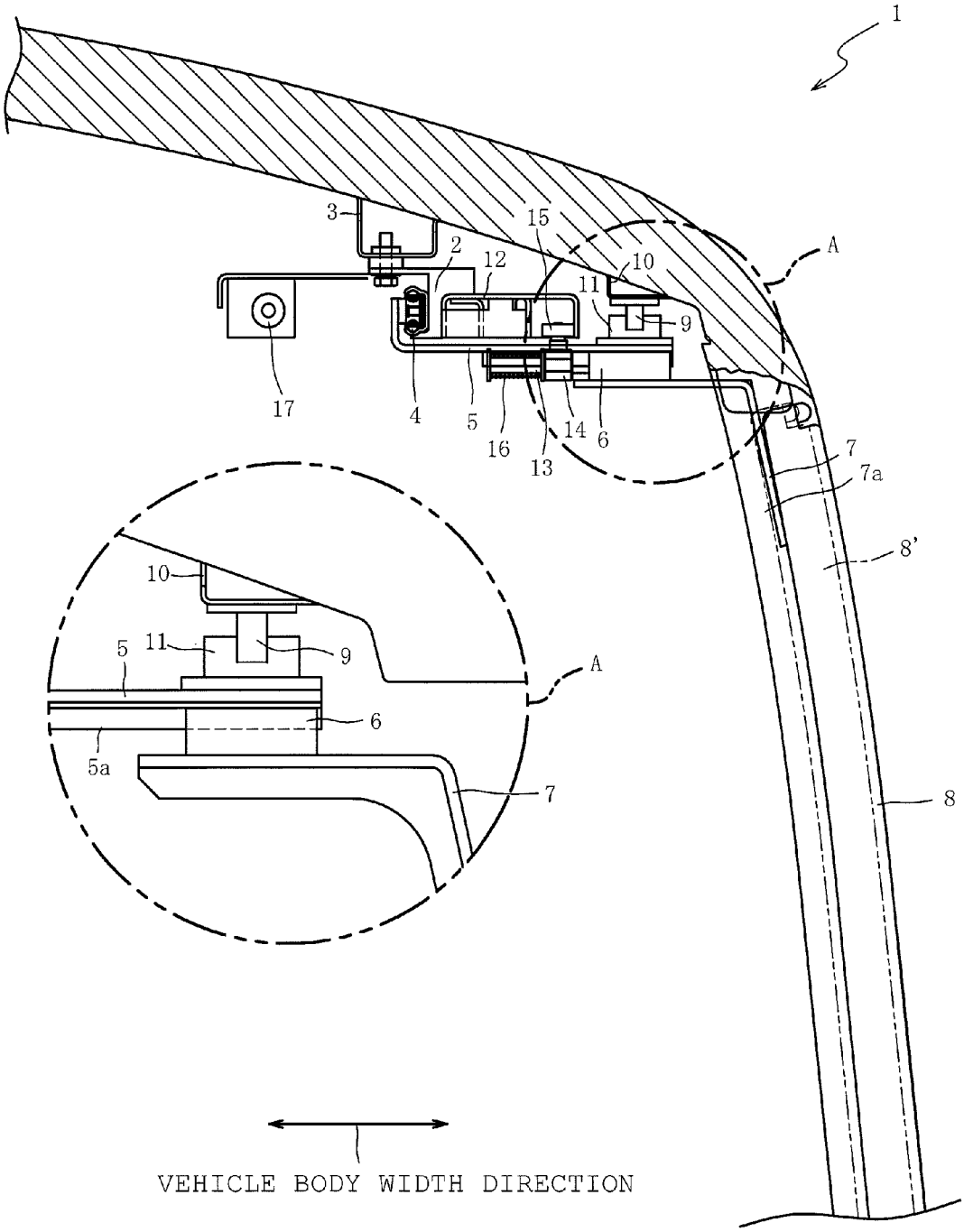
FIG. 1 is a sectional side view of a railroad vehicle.
Figure 2:
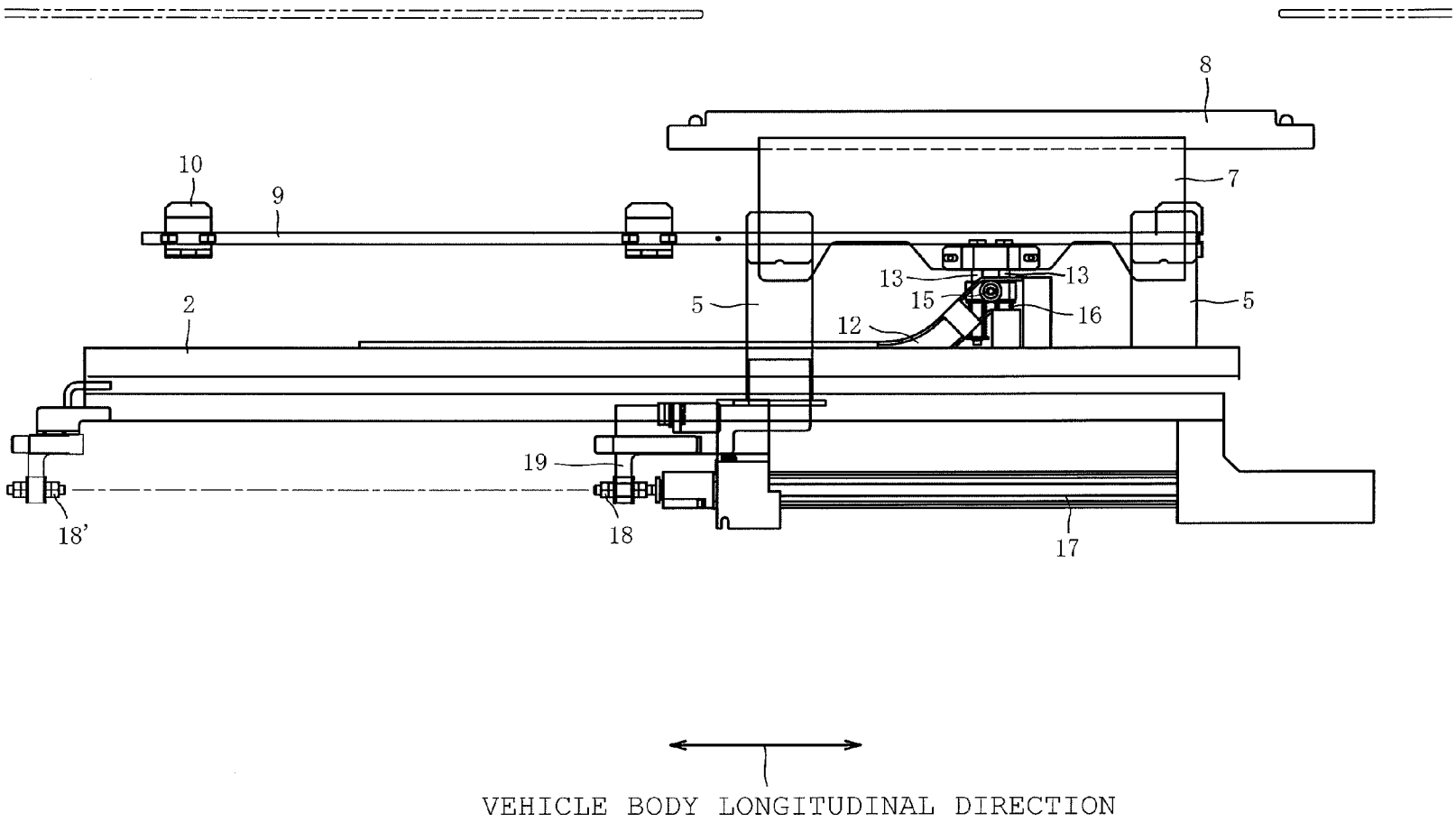
FIG. 2 is a plan view of the railroad vehicle.
Figure 3:
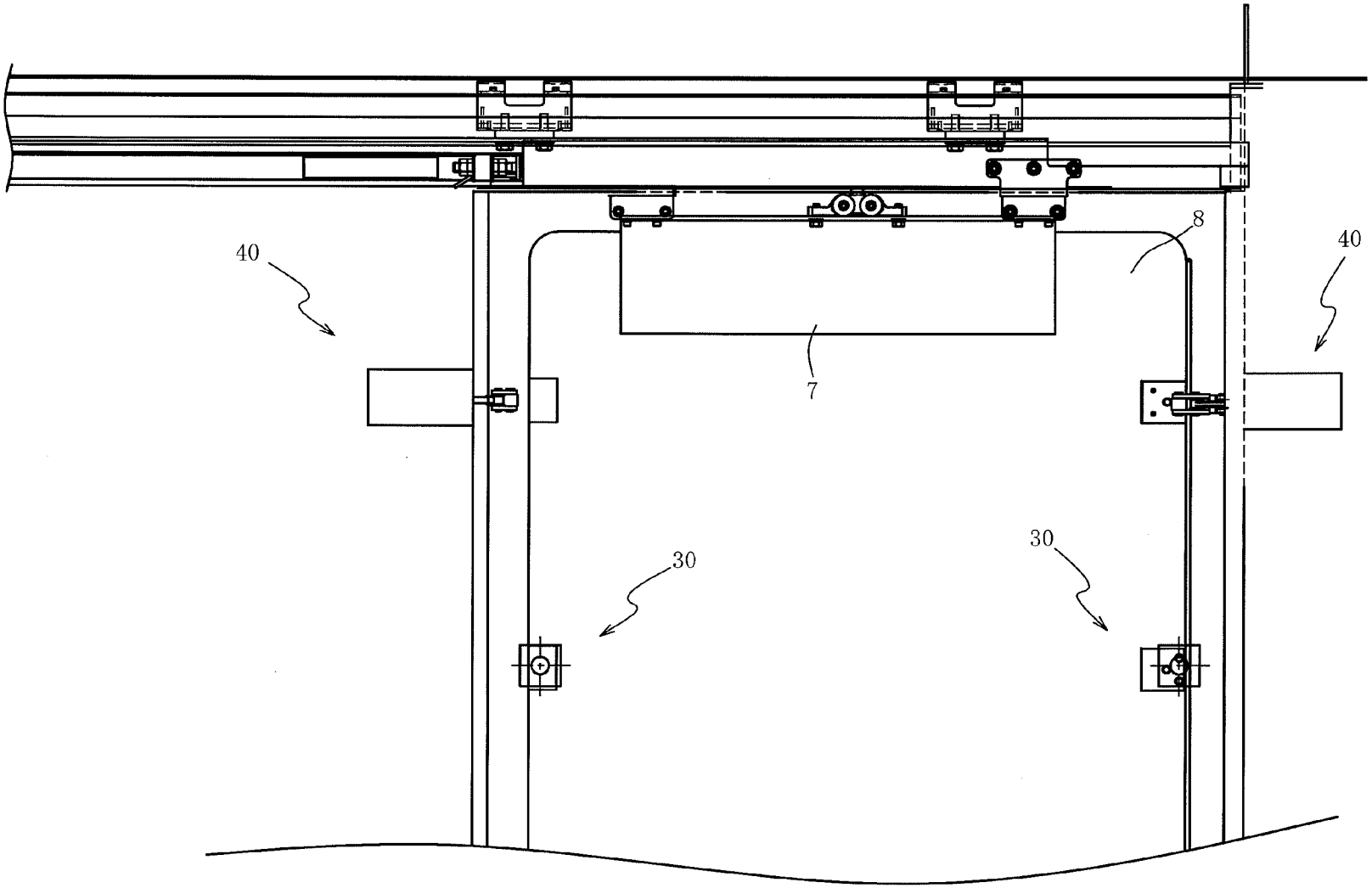
FIG. 3 is a front view of the railroad vehicle.

Hereinafter, a preferred embodiment of the present invention will be described with reference to the accompanying drawings. FIG. 1 is a sectional side view of a railroad vehicle 1; FIG. 2 is a plan view of the railroad vehicle 1; and FIG. 3 is a front view of the railroad vehicle 1.

The railroad vehicle 1 is provided with a first rail 2 extending in a vehicle body longitudinal direction (i.e., from the near side to the far side of the drawing sheet in FIG. 1). The first rail 2 is fixed through a U-shaped hanging fitting 3 that is fixed to a frame (not shown) in a ceiling. A bearing fitting 4 abuts on one surface (the left side surface in FIG. 1) of the first rail 2. The bearing fitting 4 moves in the vehicle body longitudinal direction along the one surface of the first rail 2. An L-shaped plug rail 5 is coupled to the bearing fitting 4.

The plug rail 5 extends downwardly from the bearing fitting 4 and then is bent to extend toward a door 8. A rail 5*a* (see Portion A in FIG. 1) is formed on an extended end of the plug rail 5, and a moving member 6 is provided at the rail 5*a* so as to be movable in a vehicle body width direction (i.e., in the horizontal direction in FIG. 1).

An L-shaped door-hanging fitting 7 is coupled to a lower surface of the moving member 6 so as to couple the moving member 6 and the door 8. The door 8 is provided integral with the moving member 6 through the door hanging fitting 7 so as to be movable in the vehicle body width direction (i.e., in the horizontal direction in FIG. 1). The door 8 is adapted to open and close a doorway of the railroad vehicle 1.

A second rail 9 is provided parallel to the first rail 2 in the vehicle longitudinal direction above the leading end side (door 8 side) of the plug rail 5 (see FIG. 2). The second rail 9 supports the leading end side (door 8 side) of the plug rail 5. As a result, both ends of the plug rail 5 are supported by the first rail 2 and the second rail 9. Dangling of the leading end side of the plug rail 5 can be thus prevented even when the plug distance (the distance that the door 8 moves in the vehicle body width direction) is long. That is, dangling of the door 8 coupled to the plug rail 5 through the door hanging fitting 7 can be prevented. It is therefore possible to block the doorway without leaving a gap using the door 8 and to ensure the air tightness of the door 8.

Furthermore, as shown in FIG. 1, the second rail 9 is fixed through an L-shaped hanging fitting 10 that is fixed to the frame (not shown) in the ceiling. A block piece 11 is configured to be movable in the vehicle body longitudinal direction along the second rail 9.

Furthermore, a guide passage 12 is coupled to the other surface (the right side surface in FIG. 1) of the first rail 2. The guide passage is the passage through which a rotating roller 15 to be described later passes, and, as shown in FIG. 2, composed of a straight passage along the first rail 2 and a bent passage that is bent toward the center of the gateway from one end of the straight passage.

As shown in FIG. 2, two shafts 13 are coupled between the plug rails 5 at a central portion of the door hanging fitting 7. A slide member 14 is inserted on the two shafts 13. A rotary shaft is erected on the upper surface of the slide member 14, and the rotating roller 15 is rotatably provided on the rotary shaft.

Furthermore, a coil spring 16 is inserted on each of the two shafts 13 on the opposite side across the slide member 14 from the door 8 so as to urge the slide member 14 toward the door 8. Thus, the rotating roller 15 travels while separating the door 8 from the wall surface when passing through the inside of the guide passage 12, and can also move smoothly from the straight passage to the bent passage of the guide passage 12.

Further, as shown in FIG. 2, inside the first rail 2 (on the lower side in FIG. 2), there are provided an air cylinder 17 and a rod 18 that telescopes in parallel with the first rail 2 from the air cylinder 17. The rod 18 can telescope from its position shown in FIG. 2 to the position indicated by a rod 18'. The rod 18 is also coupled to the bearing fitting 4 through a coupling fitting 19.

Therefore, the telescopic motion of the rod 18 allows the bearing fitting 4, the plug rail 5 coupled to the bearing fitting 4, the moving member 6 coupled to the plug rail 5, the door hanging fitting 7, the door 8, and the block piece 11 to reciprocate in the vehicle body longitudinal direction. It should be noted that the shafts 13, the slide member 14, and the rotating roller 15 are also allowed to reciprocate in the vehicle body longitudinal direction through the door hanging fitting 7.

In contrast, as shown in FIG. 1, the door 8 cannot be moved beyond the position of a door 8' indicated by the two-dot dash line in FIG. 1, simply by the telescopic motion of the rod 18. That is, it is an auxiliary pressing device 30 and a main pressing device 40 to be described later that move the moving member 6 in the vehicle body width direction along the rail 5*a* of the plug rail 5 and move the door 8 to the position of the door 8 indicated by the solid line in FIG. 1.

As shown in FIG. 3, the auxiliary pressing device 30 and the main pressing device 40 are arranged around the door 8. The auxiliary pressing device 30 is a pressing device that is disposed to face the inner surface of the door 8 and presses the door 8 toward the door frame. The main pressing device 40 is a pressing device that is disposed adjacent to the door 8 in the vehicle body longitudinal direction and presses the door 8 toward the door frame. To close the door 8, the auxiliary pressing device 30 is brought into operation first, and then the main pressing device 40 is brought into operation.

It should be noted that, in FIG. 3, a pair of left and right main pressing devices 40 on the same level is shown on the upper side, and below them, a pair of left and right auxiliary pressing devices 30 on the same level is shown. However, actually, a pair of left and right main pressing devices 40 on the same level is provided below the auxiliary pressing devices 30, and below them, a pair of left and right auxiliary pressing devices 30 on the same level is provided, and further below them, a pair of left and right main pressing devices 40 on the same level is provided.

That is, the three main pressing devices 40 and the two auxiliary pressing devices 30 are alternately provided on the left side. Also in the same manner, the three main pressing devices 40 and the two auxiliary pressing devices 30 are alternately provided on the right side. Thus, it is possible to equally press the door 8 against the door frame and to ensure the air tightness.

Next, referring to FIGS. 4 to 6, the auxiliary pressing device 30 and the main pressing device 40 for pressing the door 8 against the door frame will be described in concrete terms.

Figure 4B:
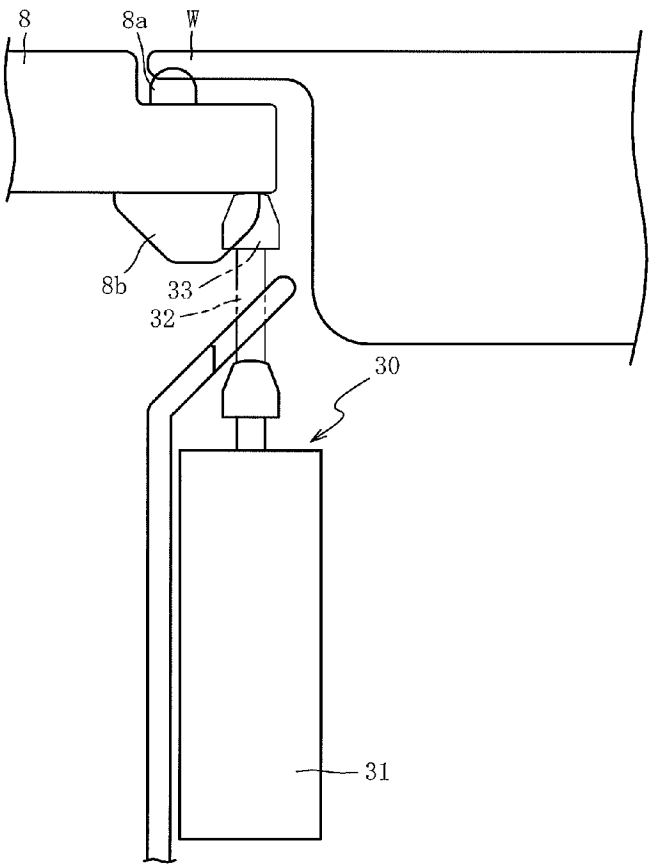
FIG. 4(*a*) is a schematic diagram showing a state in which an auxiliary pressing device is unoperated, and FIG. 4(*b*) is a schematic diagram showing a state in which the auxiliary pressing device is in operation.
Figure 4A:
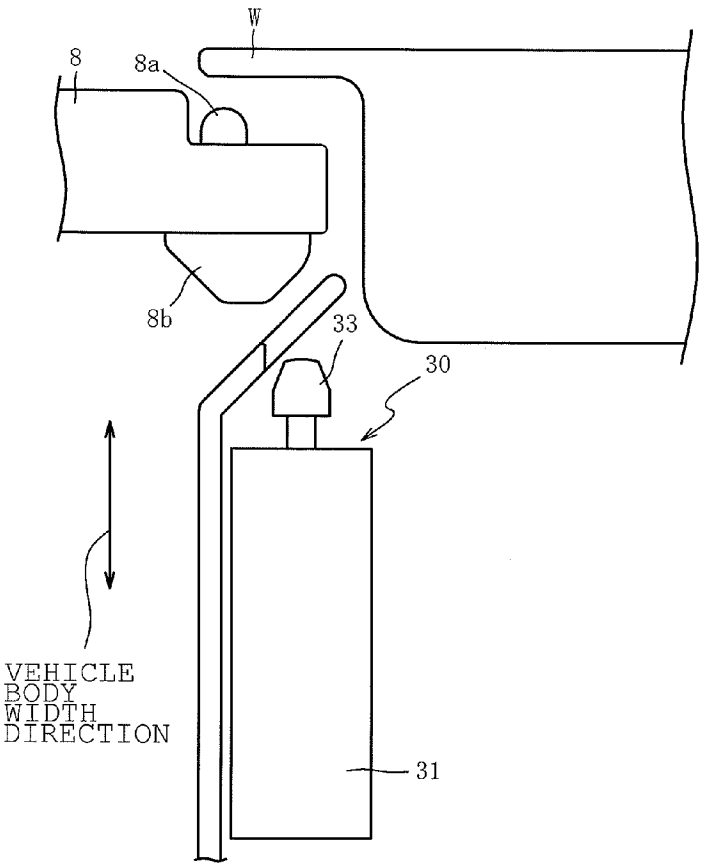

FIG. 4(*a*) is a schematic diagram showing a state in which the auxiliary pressing device is unoperated, and FIG. 4(*b*) is a schematic diagram showing a state in which the auxiliary pressing device is in operation. It should be noted that FIG. 4 shows the schematic diagram on the door end side of the door 8.

The auxiliary pressing device 30 is adapted to further move the door 8' indicated by the two-dot dash line in FIG. 1 toward the doorway and press the door 8 against a door frame W. The auxiliary pressing device 30 is provided inside an in-vehicle wall extending in the vehicle body width direction and fixed to a frame of the wall. The auxiliary pressing device 30 is composed of an air cylinder 31, a piston 32 (FIG. 4(*b*)) that telescopes in the vehicle body width direction from the air cylinder 31, and a pressing member 33 that is coupled to a leading end of the piston 32 and abuts on the inner surface of the door 8 to press the door 8.

When the door 8 is moved to the position 8' indicated by the two-dot dash line in FIG. 1, the piston 32 is extended in the vehicle width direction to cause the pressing member 33 to abut on the inner surface of the door 8 so as to move the door 8 toward the door frame W (in the vehicle body width direction). It should be noted that the door 8 is provided with a rubber airtight cap 8*a*, and the air tightness of the door 8 can be ensured by pressing the airtight cap 8*a* against the door frame W. Furthermore, the auxiliary pressing device 30 causes the piston 32 to abut perpendicularly on the inner surface of the door 8, thereby allowing efficient movement and press of the door 8.

Moreover, a blocking wall 8*b* that surrounds the portion of the door 8 on which the pressing member 33 abuts is provided inward the vehicle on an inner surface (on the door end side) of the door 8. Thus, an accident, such as pinching a finger between the pressing member 33 and the inner surface of the door 8, can be prevented. It should be noted that a gap between the leading end of the blocking wall 8*b* and the obliquely-extending wall surface is of a size so that the finger does not enter the gap.

Figure 5A:
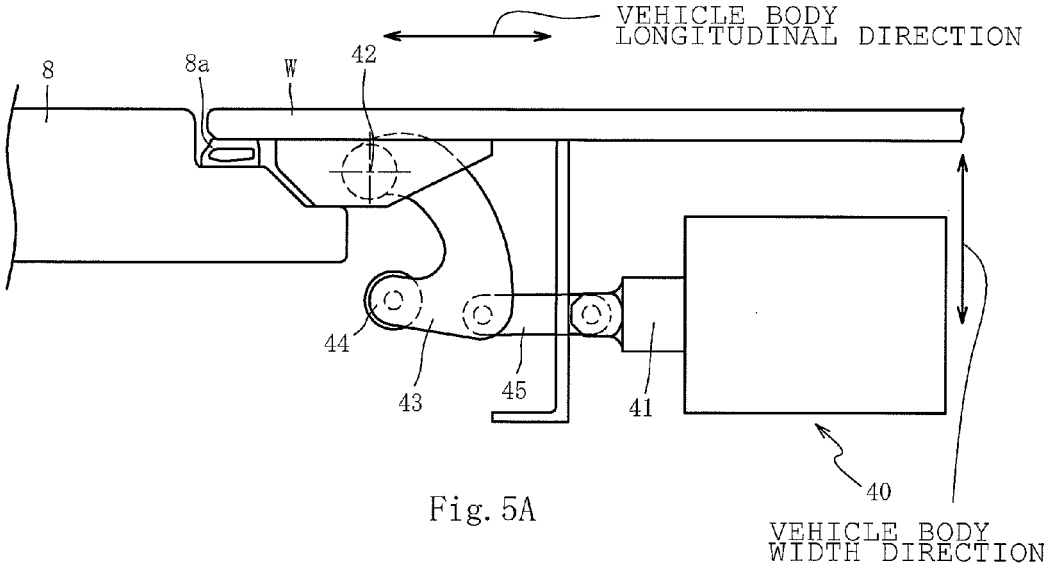
FIG. 5(*a*) is a schematic diagram showing a state in which a main pressing device is unoperated, and FIG. 5(*b*) is a schematic diagram showing a state in which the main pressing device is in operation.
Figure 5B:
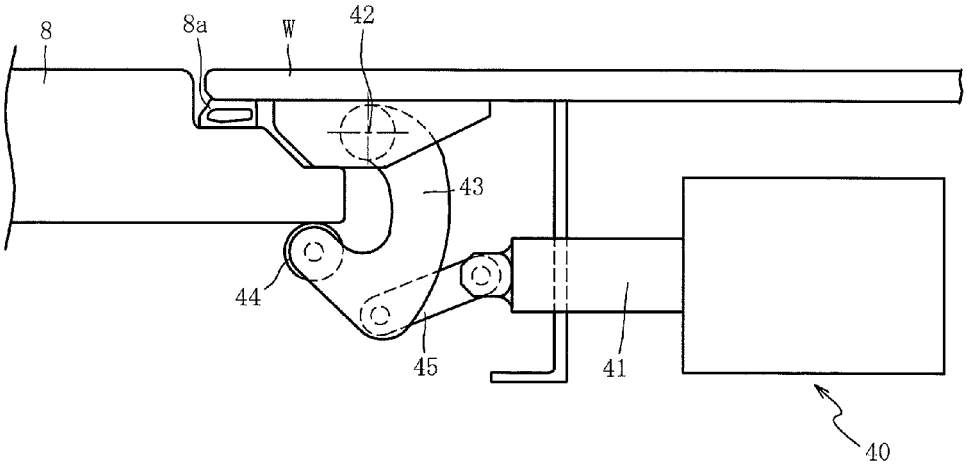

FIG. 5(*a*) is a schematic diagram showing a state in which the main pressing device is unoperated, and FIG. 5(*b*) is a schematic diagram showing a state in which the main pressing device is in operation. The main pressing device 40 is adapted to further press the door 8 moved to the position shown in FIG. 4(*b*) by the auxiliary pressing device 30 against the door frame W. The main pressing device 40 is provided inside a vehicle side wall and fixed to a frame of the vehicle side wall.

The main pressing device 40 is provided with an air cylinder 41 and a piston that telescopes in the vehicle body longitudinal direction from the air cylinder 41. The main pressing device 40 is also provided with: a rotary shaft 42 coupled to the inner surface of the vehicle body side wall and extending vertically; an arm 43 journaled to the rotary shaft 42 and extending inward the vehicle, a leading end thereof being bent toward the inner surface of the door 8; a rotating roller 44 turnably journaled to the leading end of the arm 43; and a link member 45 having one end that is rotatably coupled to the leading end of the piston and the other end that is rotatably coupled to the arm 43. It should be noted that the leading end of the piston is provided with a rotary shaft and the one end of the link member 45 is coupled to the rotary shaft. Furthermore, the arm 43 is mounted to the rotating roller 44 and the link member 45 in such a manner as to be rotatable on the rotary shaft.

With the main pressing device 40, when the piston is extended in the vehicle body longitudinal direction, the link member 45 causes the arm 43 to rotate about the rotary shaft 42, and the rotating roller 44 turnably journaled to the leading end of the arm 43 abuts the inner surface of the door 8 and presses the door 8 toward the door frame W. In this case, even if an external force is applied from the outer surface of the door 8, the external force is distributed without acting directly upon the link member 45 and the piston. It is therefore possible to resist the external force and ensure or maintain the air tightness of the door 8 without increasing the size of the cylinder 41.

That is, if the main pressing device 40 and the auxiliary pressing device 30 are operated in reverse order, the main pressing device 40 cannot move the door 8 over a long distance. In order to move the door 8 over a long distance, it is necessary to increase the size of the arm 43, and, accordingly, also to increase the size of the cylinder. Furthermore, it is necessary to increase the size of the cylinder 31, because the external force acts directly upon the piston 32 in the auxiliary pressing device 30.

As described above, causing the main pressing device 40 and the auxiliary pressing device 30 to work in reverse order leads to an increase in the size of the cylinder device. However, according to the aspect of this embodiment, there is no need to increase the size of the cylinder device. In this manner, according to this embodiment, it is possible to efficiently move the door 8 to an airtight position and ensure or maintain the air tightness of the door without increasing the size of the cylinder device even when the door 8 must be moved across a distance to arrive at the airtight position.

Figure 6A:
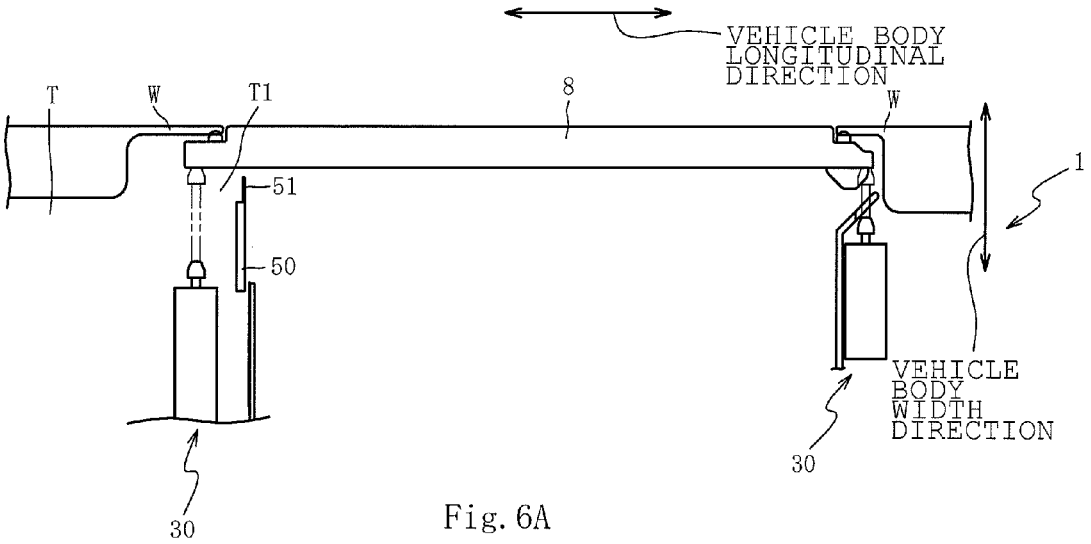
FIG. 6(*a*) is a schematic diagram showing a state in which a door is pressed by the auxiliary pressing devices, FIG. 6(*b*) is a schematic diagram showing a state at the time of storing the door in a door pocket, and FIG. 6(*c*) is a schematic diagram showing a state at the time of removing the door from the door pocket.
Figure 6B:
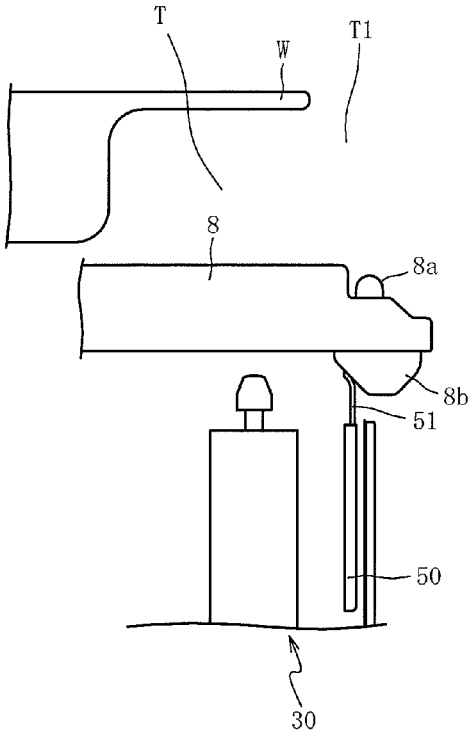
Figure 6C:
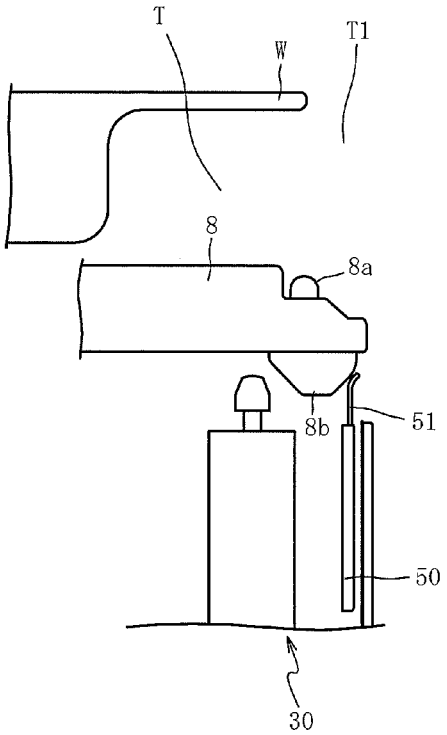

FIG. 6(*a*) is a schematic diagram showing a state in which the door is pressed by the auxiliary pressing devices, (b) is a schematic diagram showing a state at the time of storing the door in a door pocket, and (c) is a schematic diagram showing a state at the time of removing the door from the door pocket.

As shown in FIG. 6(*a*), the railroad vehicle 1 is provided with a door pocket T that stores the door 8 when the door 8 is opened toward the door tail (to the left side in FIG. 6) of the door 8. An opening/closing door 50 for opening and closing an entrance T1 of the door pocket T is also provided. Therefore, when the door 8 is closed (at timing before the auxiliary pressing device 30 is brought into operation), the opening/closing door 50 is moved toward the door 8 so as to close the entrance T1 of the door pocket T. Thus, it is possible to prevent a finger from being inserted through the entrance T1 of the door pocket T and pinched by the auxiliary pressing device 30 or the main pressing device 40.

In contrast, when the door 8 is stored in the door pocket T as shown in FIG. 6(*b*) or when the door 8 is removed from the door pocket T as shown in FIG. 6(*c*), the blocking wall 8*b* provided in a protruding manner on the door 8 abuts on a leading end 51 of the opening/closing door 50.

Therefore, in this embodiment, the portion of the leading end 51 of the opening/closing door 50 through which the blocking wall 8*b* passes is made of rubber or a brush. Thus, even if the blocking wall 8*b* is provided in a protruding manner on the door 8, the entrance T1 of the door pocket T can be covered. It is therefore possible to prevent, for example, the inadvertent entry of a finger from the portion through which the blocking wall 8*b* passes.

While an embodiment of the present invention has been described above, the present invention is by no means limited to the above embodiment, and it is obvious that various modifications may be made without departing from the scope of the present invention.

The invention claimed is:

1. A railroad vehicle provided with a side wall of a vehicle body, a doorway opened in the side wall of the vehicle body, a door that opens and closes the doorway, and a plug mechanism that moves the door to a position where an outer surface of the door is flush with an outer surface of the vehicle body when the doorway is closed by the door, comprising:

a first pressing device that is disposed adjacent to the door in a longitudinal direction of the vehicle body and adapted to press the door toward the outside of the vehicle, the first pressing device having a first piston and a link mechanism, the first piston telescoping in the vehicle body longitudinal direction, and the link mechanism abutting on an inner surface of the door with the telescopic motion of the first piston and rotationally moving the door in a direction to press the door toward the outside of the vehicle and in the reverse direction thereof; and a second pressing device that is disposed to face the inner surface of the door and adapted to press the door toward the outside of the vehicle, the second pressing device having a second piston and a pressing member, the second piston telescoping in a width direction of the vehicle body, and the pressing member being coupled to a leading end of the second piston, the pressing member abutting on the inner surface of the door with the telescopic motion of the second piston and moving the door in a direction to press the door toward the outside of the vehicle and in the reverse direction thereof, wherein, when the door is closed, the door is pressed by the second pressing device prior to being pressed by the first pressing device.

2. The railroad vehicle according to claim 1, wherein the first pressing device is disposed on the same level on both sides of the door so as to sandwich the door therebetween in the vehicle body longitudinal direction;

the second pressing device is disposed on the same level on both sides of the door so as to sandwich the door therebetween in the vehicle body longitudinal direction; and the first and second pressing devices are vertically alternately arranged.

3. The railroad vehicle according to claim 1, further comprising:

a blocking wall that is provided in a manner protruding inward the vehicle on a door end side of the door, the blocking wall surrounding a portion of the door on which the first pressing device or the second pressing device abuts;

a door pocket that stores the door when the doorway is opened;

a shutter that opens and closes an entrance of the door pocket; and a covering member that is provided at a leading end of the shutter, the covering member covering a portion through which the blocking wall passes while allowing passage of the blocking wall.

4. The railroad vehicle according to claim 1, wherein the plug mechanism is provided with:

a first rail that is suspended from a ceiling of the vehicle body and extends in the vehicle body longitudinal direction, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway; and a plug rail that extends between the first rail and the second rail, the plug rail guiding the door in movement in the vehicle body width direction.

5. The railroad vehicle according to claim 1, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

6. A plug door for a railroad vehicle provided with a door that opens and closes a doorway opened in a side wall of a vehicle body of the railroad vehicle and a plug mechanism that moves the door to a position where an outer surface of the door is flush with an outer surface of the vehicle body when the doorway is closed by the door, comprising:

a first pressing device that is disposed adjacent to the door in a longitudinal direction of the vehicle body and adapted to press the door toward the outside of the vehicle, the first pressing device having a first piston and a link mechanism, the first piston telescoping in the vehicle body longitudinal direction, and the link mechanism abutting on an inner surface of the door with the telescopic motion of the first piston and rotationally moving the door in a direction to press the door toward the outside of the vehicle and in the reverse direction thereof; and a second pressing device that is disposed to face the inner surface of the door and adapted to press the door toward the outside of the vehicle, the second pressing device having a second piston and a pressing member, the second piston telescoping in a width direction of the vehicle body, and the pressing member being coupled to a leading end of the second piston, the pressing member abutting on the inner surface of the door with the telescopic motion of the second piston and moving the door in a direction to press the door toward the outside of the vehicle and in the reverse direction thereof, wherein, when the door is closed, the door is pressed by the second pressing device prior to being pressed by the first pressing device.

7. The railroad vehicle according to claim 2, further comprising:

a blocking wall that is provided in a manner protruding inward the vehicle on a door end side of the door, the blocking wall surrounding a portion of the door on which the first pressing device or the second pressing device abuts;

a door pocket that stores the door when the doorway is opened;

a shutter that opens and closes an entrance of the door pocket; and a covering member that is provided at a leading end of the shutter, the covering member covering a portion through which the blocking wall passes while allowing passage of the blocking wall.

8. The railroad vehicle according to claim 2, wherein the plug mechanism is provided with:

a first rail that is suspended from a ceiling of the vehicle body and extends in the vehicle body longitudinal direction, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway; and a plug rail that extends between the first rail and the second rail, the plug rail guiding the door in movement in the vehicle body width direction.

9. The railroad vehicle according to claim 3, wherein the plug mechanism is provided with:

a first rail that is suspended from a ceiling of the vehicle body and extends in the vehicle body longitudinal direction, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway; and a plug rail that extends between the first rail and the second rail, the plug rail guiding the door in movement in the vehicle body width direction.

10. The railroad vehicle according to claim 7, wherein the plug mechanism is provided with:

a first rail that is suspended from a ceiling of the vehicle body and extends in the vehicle body longitudinal direction, the first rail guiding the door in reciprocal movement in the vehicle body longitudinal direction with respect to the doorway;

a second rail that is suspended from the ceiling of the vehicle body between the first rail and the side wall of the vehicle body and extends in the vehicle body longitudinal direction, the second rail guiding the door in reciprocal movement in the vehicle body longitudinal direction with respect to the doorway; and a plug rail that extends between the first rail and the second rail, the plug rail guiding the door in movement in the vehicle body width direction.

11. The railroad vehicle according to claim 2, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

12. The railroad vehicle according to claim 3, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

13. The railroad vehicle according to claim 4, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

14. The railroad vehicle according to claim 7, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

15. The railroad vehicle according to claim 8, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

16. The railroad vehicle according to claim 9, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

17. The railroad vehicle according to 10, wherein the link mechanism of the first pressing device is provided with:

a rotary shaft that is coupled to the inner surface of the side wall of the vehicle body and extends vertically;

an arm that is journaled to the rotary shaft and extends inward the vehicle, a leading end thereof being bent toward the inner surface of the door;

a rotating roller that is turnably journaled to the leading end of the arm; and a link member that has one end rotatably coupled to a leading end of the first piston and the other end rotatably coupled to the arm.

* * * * *